US007379702B2

(12) United States Patent
Kim

(10) Patent No.: US 7,379,702 B2
(45) Date of Patent: May 27, 2008

(54) PAPER REVERSE-FEEDING APPARATUS FOR IMAGE FORMING APPARATUS

(75) Inventor: Jong-Sung Kim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 175 days.

(21) Appl. No.: 11/037,144

(22) Filed: Jan. 19, 2005

(65) Prior Publication Data

US 2005/0254871 A1 Nov. 17, 2005

(30) Foreign Application Priority Data

May 17, 2004 (KR) ..... 10-2004-0034709

(51) Int. Cl.
*G03G 15/00* (2006.01)

(52) U.S. Cl. ..... 399/401; 399/405

(58) Field of Classification Search ..... 399/401, 399/405, 397, 381, 361
See application file for complete search history.

(56) References Cited

U.S. PATENT DOCUMENTS

| | | | | |
|---|---|---|---|---|
| 5,791,645 | A * | 8/1998 | Takada | 271/3.03 |
| 5,974,283 | A * | 10/1999 | Cho | 399/75 |
| 6,522,860 | B2 * | 2/2003 | Nose et al. | 399/374 |
| 6,621,997 | B2 * | 9/2003 | Chung | 399/122 |
| 6,725,011 | B2 * | 4/2004 | Sato | 399/405 |
| 2003/0185610 | A1 * | 10/2003 | Jeong | 399/401 |

FOREIGN PATENT DOCUMENTS

| | | |
|---|---|---|
| CN | 1380588 | 11/2002 |
| JP | 62-171832 | 7/1987 |
| JP | 63-235250 | 9/1988 |
| JP | P02-056387 | 2/1990 |
| JP | P02-158760 | 6/1990 |
| JP | P05-131696 | 5/1993 |
| JP | P10-036014 | 2/1998 |
| JP | 2000-029252 | 1/2000 |
| JP | 2002-128354 | 5/2002 |
| KR | 10-0402800 | 10/2003 |

* cited by examiner

*Primary Examiner*—Anthony H. Nguyen
(74) *Attorney, Agent, or Firm*—Roylance, Abrams, Berdo & Goodman, L.L.P.

(57) ABSTRACT

Disclosed is an image forming apparatus capable of increasing double-side-printing speed. The image forming apparatus comprises a paper transfer unit provided with a plurality of paper transfer sub-units for feeding a printing paper to a double-side-printing paper transfer path for reversing a printing paper. The paper transfer direction is switched by a switching unit selectively engaged with the respective paper transfer sub-units. According to the embodiments of the present invention, because the paper transfer sub-units always rotate in their own directions, it is possible to prevent the delay of printing caused in the process of switching reverse and forward rotations of a conventional paper transfer unit for reversing a paper, whereby the double-side-printing speed can be increased.

16 Claims, 5 Drawing Sheets

PAPER REVERSE-FEEDING APPARATUS FOR IMAGE FORMING APPARATUS

CROSS-REFERENCE TO RELATED APPLICATIONS

This application claims the benefit under 35 U.S.C. §119 (a) of Korean Patent Application No. 2004-34709, filed May 17, 2004 in the Korean Intellectual Property Office, the entire contents of which are hereby incorporated by reference.

BACKGROUND OF THE INVENTION

1. Field of the Invention

The present invention relates to an image forming apparatus. More particularly, the present invention relates to a paper reverse-feeding apparatus for an image forming apparatus.

2. Description of the Related Art

Typically, image forming apparatuses perform single-side-printing. If a double-side-printing unit is provided with such an image forming apparatus, however, the image forming apparatus can perform double-side-printing. The double-side-printing unit is separately provided with a paper feeding path within the image forming apparatus so as to resend a single-side-printed paper to a developing unit of the image forming apparatus.

FIG. 1 shows a conventional image forming apparatus capable of performing double-side-printing. The image forming apparatus capable of performing double-side-printing comprises a main body 10 forming the appearance of the image forming apparatus as shown in the FIG. 1, a paper feeding cassette 11 mounted on the bottom of the main body 10, a pick-up roller 12 for picking up a paper from the paper feeding cassette 11, a feeding roller 13 for feeding the paper picked up by the pick-up roller 12, a developing unit 14 for developing an image on the paper fed by the feeding roller 13, and a fusing unit 15 for fixing the image developed in the developing unit 14.

The image forming apparatus further comprises a paper discharge path 16, through which the paper passing through the fusing unit 15 is discharged, and a paper discharge roller 17 installed at the outlet of the discharge path 16. A paper reverse-feeding path 20 is laterally branched from the paper discharge path 16 just before the paper discharge roller 17 and extends downwardly from the paper discharge path 16. An opening and shutting plate 21 are also provided to open or shut the paper reverse-feeding path 20.

Reverse-feeding of the paper for double-side-printing is performed if the paper is discharged through the paper discharge path 16 and the paper discharge roller 17 reverses rotation before the tail edge of the paper is completely discharged by the discharge roller 17. During the reverse-feeding process, the opening and shutting plate 21 is driven to open the paper reverse-feeding path 20 as well as to shut the paper discharge path 16, and the sheets of papers fed to the reverse-feeding path 20 are transferred by a plurality of paper transfer rollers 22 and then fed by the pick-up roller 12, so that printing can be implemented on the previously non-printed sides of the papers. Sheets of paper that are being printed on both sides make a complete loop inside the image forming apparatus.

In this case, however, because the feeding of a new printing paper to the developing unit 14 is interrupted while the paper is being transferred to the reverse-feeding path 20 and fed to the developing unit, the speed of double-side-printing is remarkably reduced as compared to that of single-side-printing. Therefore, what is needed is to develop a paper reverse-feeding apparatus for an image apparatus that can increase the speed of double-side-printing. This is important to consumers of these devices because speed in the double-side-printing mode is given much weight in regard to degree of satisfaction of users, especially in the case of an office image forming apparatus or an expensive color image forming apparatus requiring high speed printing operation.

SUMMARY OF THE INVENTION

Accordingly, the present invention has been made to solve the above-mentioned problems, and to provide other advantages that will become apparent to those of ordinary skill in the art. An object of the present invention is to provide a paper reverse-feeding apparatus with an arrangement improved in such a manner that the speed of double-side-printing can be increased and a driving source can be jointly used.

In order to achieve the above objects, there is provided a paper reverse-feeding apparatus for an image forming apparatus, comprising a paper transfer unit for feeding a printing paper to a double-side-printing paper transfer path for reversing the printing paper, the paper transfer unit having a plurality of paper transfer sub-units, of which the rotational directions are different from each other, and a switching unit for switching paper transfer direction while being selectively engaged with the paper transfer unit.

According to an exemplary embodiment of the present invention, the paper transfer unit comprises first and second paper transfer rollers, wherein the first paper transfer roller rotates in a same direction with the transfer direction of a single-side-printed paper, and the second paper transfer roller is located adjacent to the first paper transfer roller and rotates in a direction opposite to the first paper transfer roller.

In addition, the switching unit according to an exemplary embodiment of the present invention comprises a hinge member alternately contacted with and separated from the first and second paper transfer rollers while being pivoted, a first idle roller provided at a first position of the hinge member to be engaged with the first paper transfer roller as the hinge member is pivoted, and a second idle roller provided at a second position of the hinge member to be engaged with the second paper transfer roller as the hinge member is pivoted.

In still a further exemplary embodiment of the present invention, the hinge member comprises a pivot axis interposed between the first and second idle rollers. Accordingly, if the hinge member is pivoted so that the first idle roller is engaged with the first paper transfer roller, the second roller can be separated from the second paper transfer roller, and if the hinge member is pivoted so that the second idle roller is engaged with the second paper transfer roller, the first idle roller can be separated from the first paper transfer roller. The hinge member cooperates with a solenoid operated according to the selection of the single-side-printing mode or the double-side-printing mode to pivot between the first and second positions.

According to another aspect of the present invention, there is provided an image forming apparatus having a paper reverse-feeding apparatus as describe above, wherein the image forming apparatus comprises a main body of the image forming apparatus provided with an image forming section for forming a toner image, a first paper transfer path provided within the main body to guide a route of transferring a one-side-printed paper, and a second paper transfer path, of which one end is connected with the first paper transfer path and the other end is connected with the image forming section side, thereby guiding the one-side-printed paper so that the non-printed side of the paper is faced to the image forming section. The image forming apparatus further comprises a paper transfer unit for feeding a printing paper to a double-side-printing paper transfer path for reversing a printing paper, the paper transfer unit having a plurality of paper transfer sub-units, of which the rotational directions are different from each other, and a switching unit for switching paper transfer direction while being selectively engaged with the paper transfer unit.

Accordingly, in a paper reverse-feeding apparatus for an image forming apparatus according to an embodiment of the present invention, the efficiency of transferring a paper can be enhanced at the time of double-side-printing because the transfer direction of a single-side-printed paper can be reversed while the hinge member is pivoting and thus it is not required to switch the rotational direction of a driving source.

BRIEF DESCRIPTION OF THE DRAWINGS

The above aspects and features of the present invention will be more apparent from the description for certain embodiments of the present invention taken with reference to the accompanying drawings, in which.

DETAILED DESCRIPTION OF THE EXEMPLARY EMBODIMENTS

Figure 1:
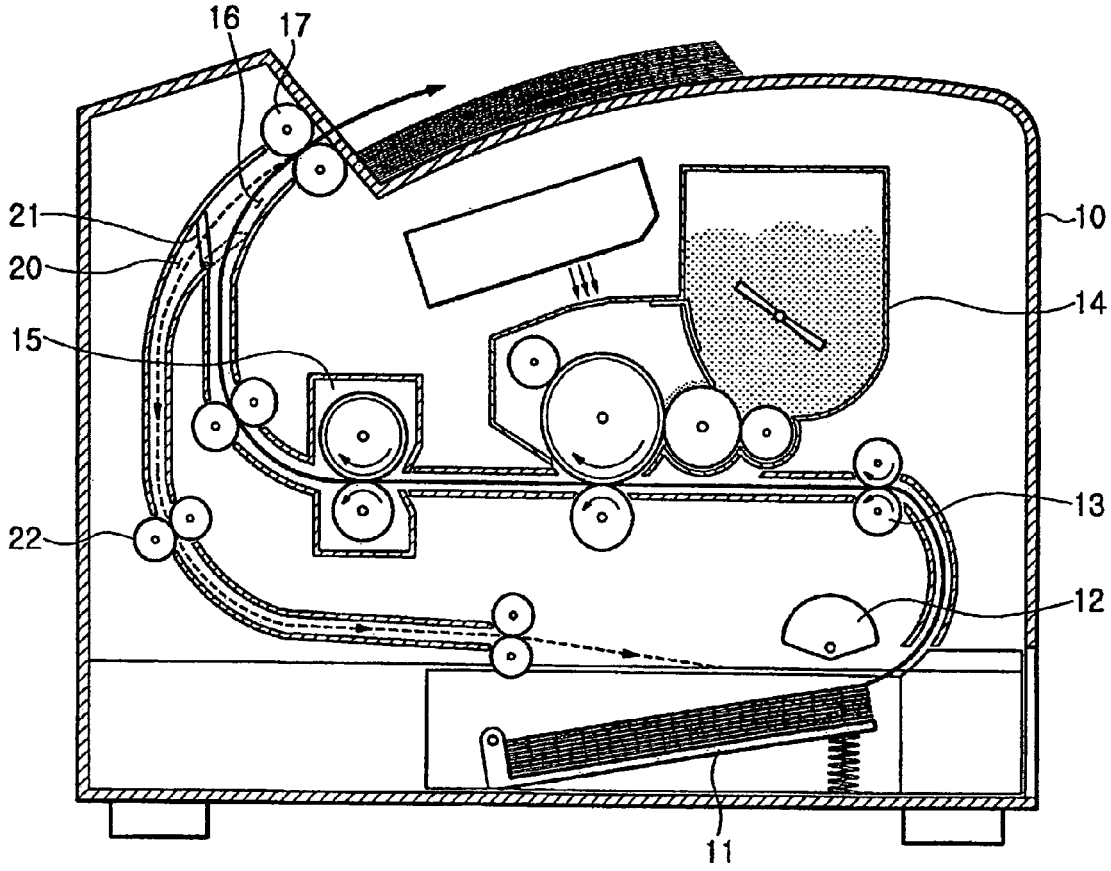
FIG. 1 (PRIOR ART)
FIG. 1 is a schematic view showing a conventional image forming apparatus having a conventional double-side-printing apparatus.

Exemplary embodiments of the present invention will now be described in detail with reference to the annexed drawings. In the drawings, the same or similar elements are denoted by the same reference numerals even though they are depicted in different drawings. In the following description, a detailed description of well known functions and configurations incorporated herein have been omitted for conciseness and clarity.

Figure 2:
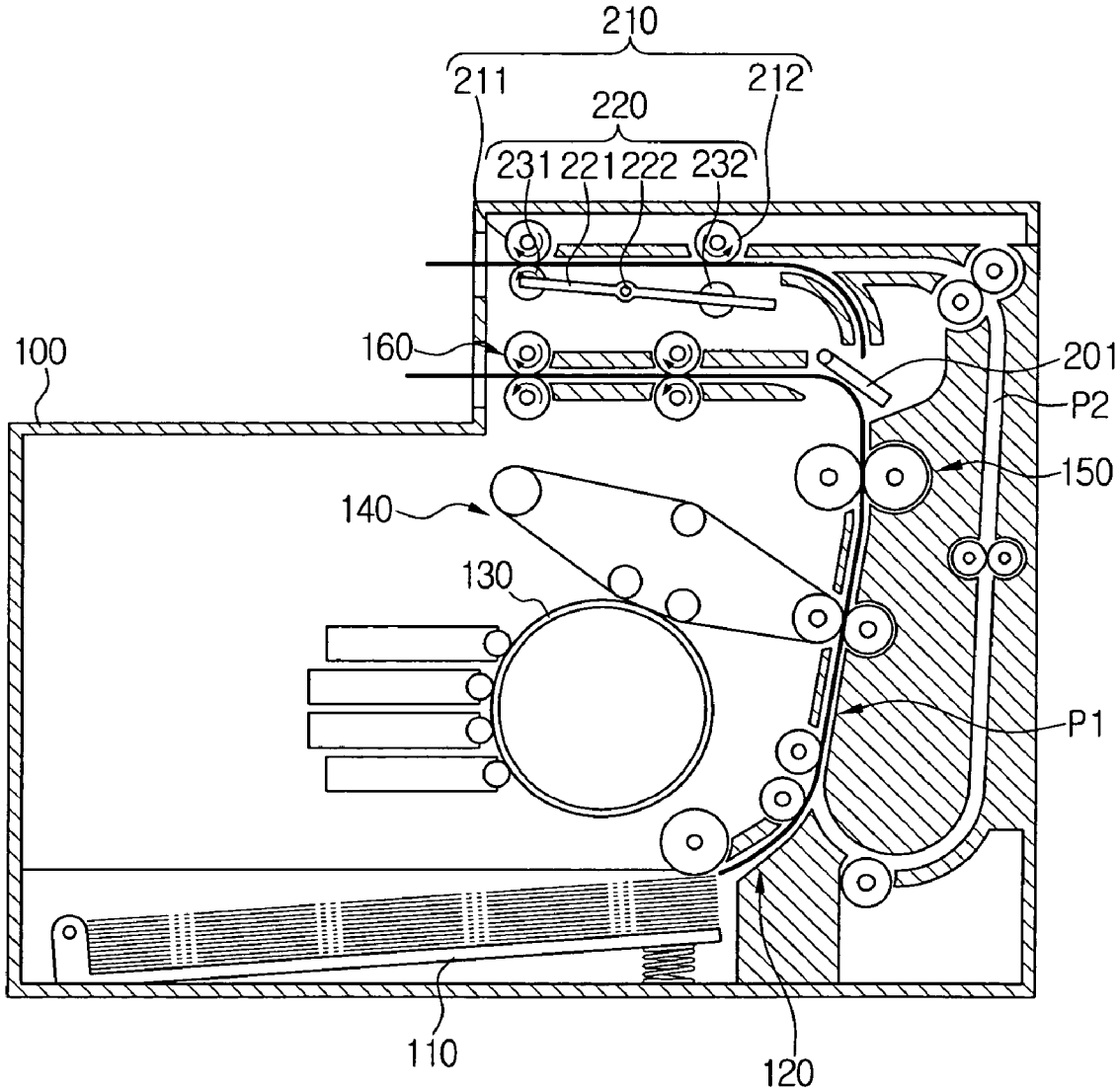
FIG. 2 is a schematic view showing an image forming apparatus constructed according to an embodiment of the present invention performing single-side-printing.
Figure 3:
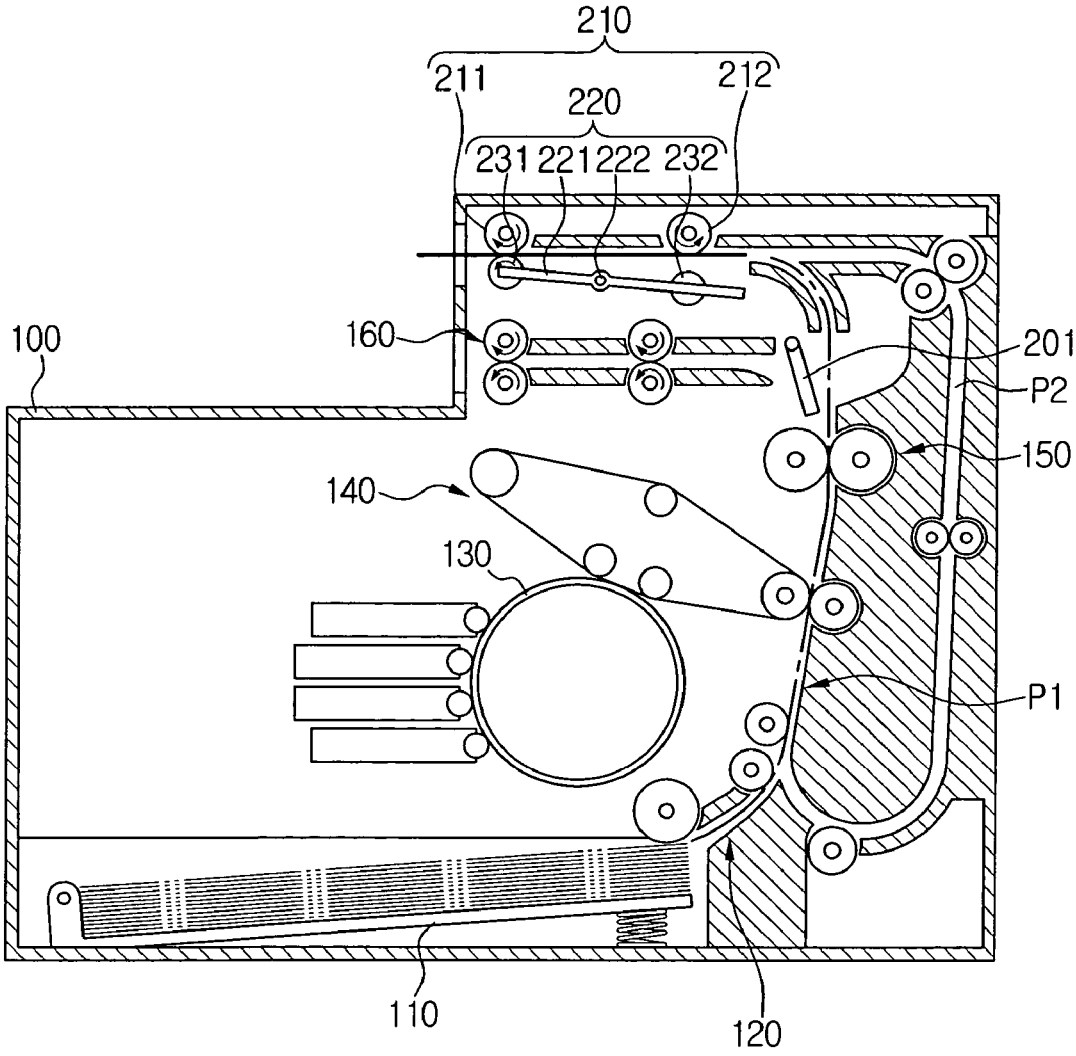
FIGS. 3 and 4 are schematic views showing the image forming apparatus of FIG. 2 performing double-side-printing.
Figure 4:
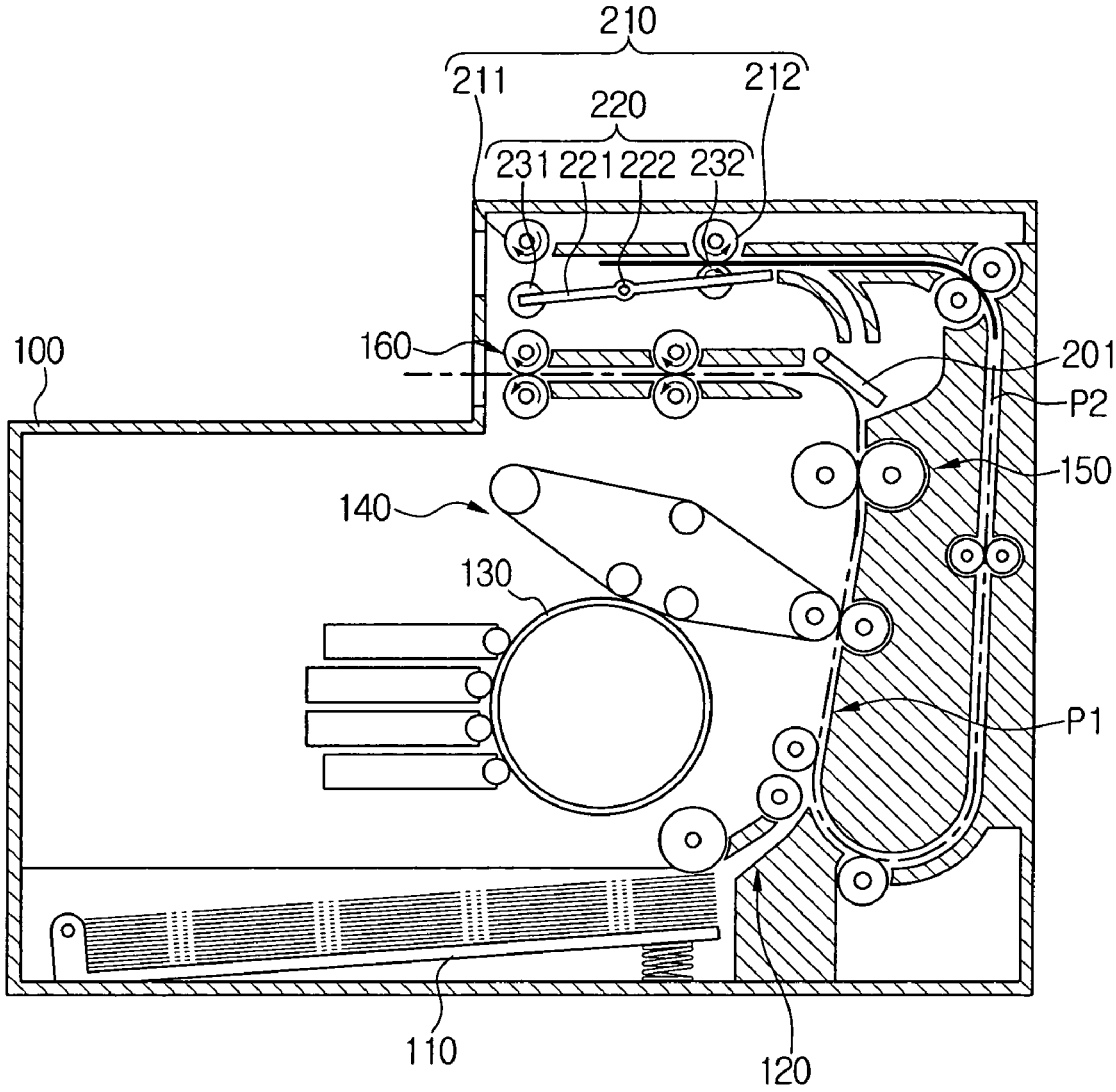
Figure 5:
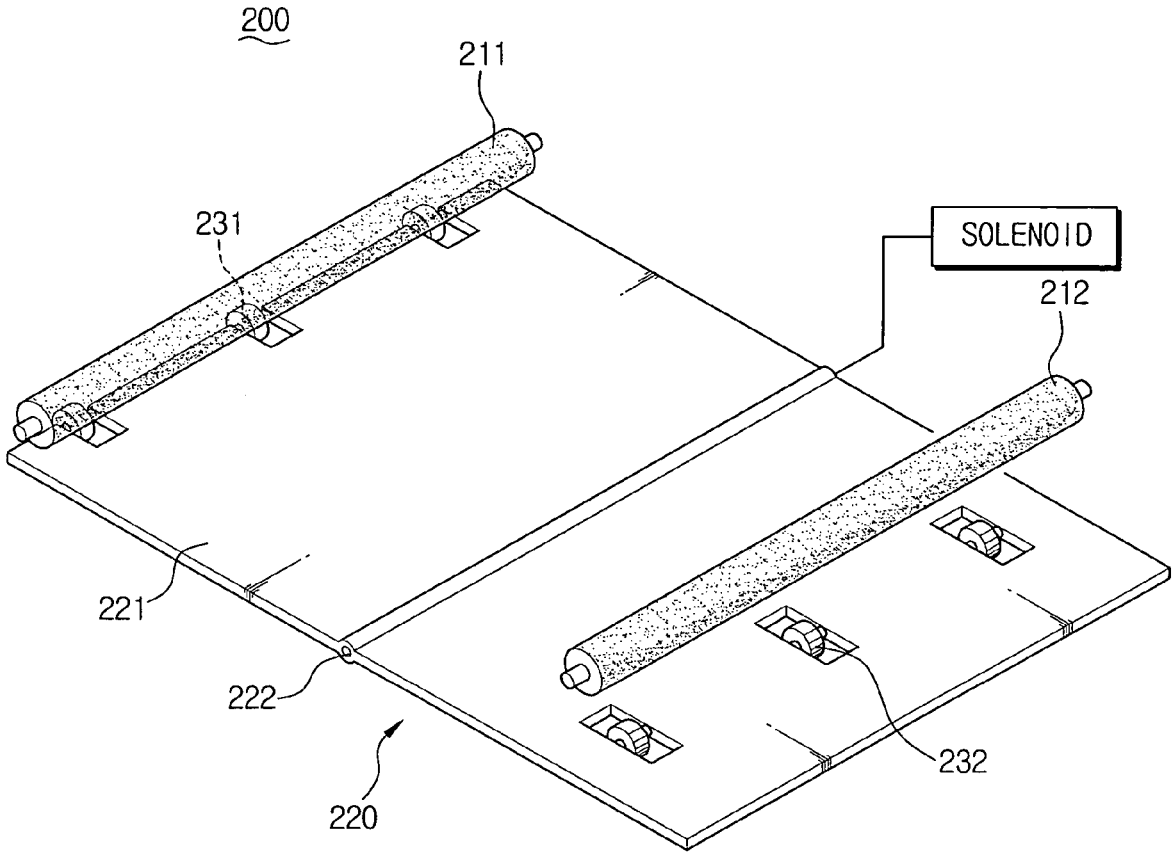
FIG. 5 is a perspective view schematically showing a paper reverse-feeding apparatus for the image forming apparatus of FIG. 2.

FIGS. 2 to 4 are schematic cross-sectional views of an image forming apparatus having a paper transfer unit according to an embodiment of the present invention, and FIG. 5 schematically shows the paper reverse-feeding apparatus of FIGS. 2-4. Although FIGS. 2 to 5 show a color laser print as the image forming apparatus by way of an example, the embodiments of the present invention are not limited to this, and can also be applicable to black-and-white laser printers, or the like.

As shown in the drawings, the image forming apparatus 100 comprises a paper feeding unit 110, a paper transfer unit 120, a photoconductive drum 130, an image transfer unit 140, a fusing unit 150, a paper discharge unit 160, and a paper reverse-feeding apparatus 200 including a paper transfer apparatus 210 and a switching transfer unit 220 (see FIG. 5). A first paper transfer path P1 is formed between the paper feeding unit 110 and the paper discharge unit 160 to transfer paper fed from the paper feeding unit 110 so as to be printed, and a single-side-printed paper guided through the first paper transfer path P1 is fed to a second paper transfer path P2 by the paper transfer apparatus 210 and the switching unit 200 and then the single-side-printed paper is transferred so that the non-printed side of the paper is faced to the image transfer unit 140.

The paper feeding unit 110 stores a plurality of sheets of paper, and continuously supplies the paper to the image transfer unit 140 through the paper transfer unit 120. The photoconductive unit 130 is formed with an electrostatic latent image at its surface by an optical scanning apparatus not shown in the drawings, and forms a visible image by being supplied with developer on the electrostatic latent image.

The image transfer unit 140 transfers the visible image formed on the photoconductive unit 130 to a printing paper, thereby performing printing. The fusing unit 150 fuses the toner image formed in the image transfer unit with a high temperature and a high pressure, so that the image is fixed on the surface of the paper. The paper discharge unit 160 discharges the paper, fed from the fusing unit, outside of the image forming apparatus 100. As shown in FIG. 5, the paper reverse-feeding apparatus 200 according to an exemplary embodiment of the present invention comprises a switching transfer unit 220 for switching paper transfer direction by being selectively engaged with the paper transfer unit 210 while being pivoted by the paper transfer unit 210 and a solenoid.

The paper transfer apparatus 210 comprises first and second paper transfer rollers 211, 212, of which the rotational directions are opposite from each other. For example, first paper transfer roller can rotate in a clockwise direction, while second paper transfer roller rotates in a counterclockwise direction. As shown in FIGS. 2 through 4, the first and second paper transfer rollers 211, 212 are located above the paper discharge unit so as to feed a single-side-printed paper supplied through the first paper transfer path P1, to the second paper transfer path P2 side.

The switching transfer unit 220 comprises a hinge member 221, and first and second idle rollers 231, 232 mounted on the hinge member 221, in which the first and second idle rollers 231, 232 are alternately engaged with the first and second paper transfer rollers 211, 212 as the hinge member 221 pivots. The pivot axis 222 of the hinge member 221 according to an exemplary embodiment of the present invention is provided between the first and second idle rollers 231, 232. The second idle roller 232 is located a predetermined distance from a first end of the hinge member 221, thereby making the hinge member 221 guide a single-side-printed paper as it is being introduced.

Hereinbelow, operation of the paper reverse-feeding apparatus according to an embodiment of the present invention for an image forming apparatus is described with reference to FIGS. 2 to 5. FIG. 2 is a view schematically showing the image forming apparatus 100 while it is being operated in the single-side-printing mode. As shown in FIG. 2, a paper fed from the paper feeding unit 110 is discharged outside of the image forming apparatus 100 by the paper discharge unit 160 after passing through the printing procedure described above. The opening and shutting plate 201 provided in the first paper transfer path P1 guides a single-side-printed paper from the fusing unit 150 to the paper discharge unit 160.

If, however, a user selects the double-side-printing mode, the opening and shutting plate 201 guides the single-side-printed paper to the second paper transfer path P2 side while being opened as shown in FIG. 3. The single-side-printed paper discharged from the fusing unit 150 is then introduced into the paper transfer unit 210 side.

The single-side-printed paper entering the paper transfer unit 210 side is transferred in the rotational direction of the first paper transfer roller 211 and the first idle roller 231, which are engaged with each other, until its leading edge arrives at a position adjacent to the second paper transfer roller 212, wherein the rotational direction is same with the paper discharge direction of from the fusing unit 150 as shown in FIG. 3.

If the single-side-printed paper arrives at the position adjacent to the second paper transfer roller 212, the hinge member 221 pivots about the pivot axis 222, as a result of which the first paper transfer roller 211 and the first idle roller 231 are separated from each other and the second paper transfer roller 212 and the second idle roller 232 are engaged with each other, as shown in FIG. 4. The second paper transfer roller 212 rotates in a counter-clockwise direction and the second idle roller rotates in a clockwise direction, causing the single-side-printed paper to move in the opposite direction as it was previously. Then, the single-side-printed paper is introduced into the second paper transfer path P2 because its progress direction is reversed. The single-side-printed paper is then transferred so that its non-printed side 242 faces the image transfer unit 140. In addition, the opening and shutting plate 201 is closed again to prevent the double-side-printed paper from being reintroduced into the paper reverse-feeding apparatus 200 side when it should be discharged. For this purpose, in an exemplary embodiment of the present invention, the opening and shutting plate 201 cooperates with a solenoid that rotates the hinge member 221.

In another embodiment of the present invention, the opening and shutting plate 201 is not always necessary and can be replaced with the inventive switching unit 220. For this purpose, one end of the hinge member may be extended, so that the extended part is capable of serving as the opening and shutting plate 201 to guide a route of a single-side-printed paper.

Accordingly, because the first paper transfer roller 211 preferably always rotates in one direction, and the second paper transfer roller 212 preferably always rotates in the opposite direction, it is not necessary to change the rotational direction of a driving source so as to reverse the direction a single-side-printed paper. Furthermore, because it is possible for the first and second paper transfer rollers 211, 212 to jointly use the same driving source as the discharge unit 160, power losses and time delays in printing caused by the reverse of such a driving source can be substantially reduced, whereby double-side-printing speed can be improved.

In accordance with the exemplary embodiments of the present invention described herein, because the paper transfer unit for feeding paper to a double-side-printing unit feeds a single-side-printed paper to the double-side-printing unit using a plurality of paper transfer rollers, of which the rotational directions are different from each other, it is possible to prevent the delay of printing caused in the process of switching reverse and forward rotations the a paper transfer unit for reversing the direction of the paper, whereby the double-side-printing speed can be increased.

Furthermore, because the first and second paper transfer rollers of the paper transfer unit for feeding paper to the double-side-printing unit always operate in their own direction, it is possible for the paper transfer unit to jointly use the same power source with the discharge unit.

While the preferred embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A paper reverse-feeding apparatus for an image forming apparatus comprising:

a paper transfer unit for feeding a printing paper to a double-side-printing paper transfer path and for reversing a printing paper with respect to an image forming section of the image forming apparatus, the paper transfer unit having a plurality of paper transfer sub-units, of which the rotational directions are different from each other; and a switching unit for switching paper transfer direction by selectively engaging said plurality of paper transfer sub-units of the paper transfer unit.

2. A paper reverse-feeding apparatus as claimed in claim 1, wherein the transfer sub-units of the paper transfer unit comprises:

a first paper transfer roller rotating in a same direction with the transfer direction of a single-side-printed paper; and a second paper transfer roller located adjacent to the first paper transfer roller and rotating in a direction opposite to the first paper transfer roller;

wherein said switching unit selectively contacts said first paper transfer roller and said second transfer roller.

3. A paper reverse-feeding apparatus as claimed in claim 2, wherein the switching unit comprises:

a hinge member being pivotally mounted for pivotal movement with respect to the first and second paper transfer rollers;

a first idle roller provided at one end of the hinge member to be engaged with the first paper transfer roller as the hinge member is pivoted to a first position; and a second idle roller provided at the other end of the hinge member to be engaged with the second paper transfer roller as the hinge member is pivoted to a second position.

4. A paper reverse-feeding apparatus as claimed in claim 3, wherein the hinge member comprises a pivot axis interposed between the first and second idle rollers.

5. A paper reverse-feeding apparatus as claimed in claim 3, wherein the hinge member is pivoted by a solenoid.

6. An image forming apparatus comprising:

a main body of the image forming apparatus provided with an image forming section for forming a toner image;

a first paper transfer path provided within the main body to guide a route of transferring a one-side-printed paper;

a second paper transfer path, of which one end is connected with the first paper transfer path and the other end is connected with the image forming section side, thereby guiding the one-side-printed paper so that a non-printed side of the paper faces the image forming section;

a paper transfer unit for feeding the one-side-printed paper to a double-side-printing paper transfer path and for reversing the one-side-printed paper with respect to the image forming section, the paper transfer unit having a plurality of paper transfer sub-units, of which the rotational directions are different from each other; and a switching unit for switching paper transfer direction by selectively engaging a first sub-unit of the paper transfer unit to transfer paper in a first direction and by engaging a second sub-unit to transfer paper in a second direction.

7. An image forming apparatus as claimed in claim 6, wherein the paper transfer unit comprises:

a first paper transfer roller rotating in a same direction with the transfer direction of the single-side-printed paper; and a second paper transfer roller located adjacent to the first paper transfer roller and rotating in a direction opposite to the first paper transfer roller;

wherein said switching unit selectively contacts said first paper transfer roller and said second transfer roller.

8. An image forming apparatus as claimed in claim 7, wherein the switching unit comprises:

a hinge member being pivotally mounted for pivotal movement with respect to the first and second paper transfer rollers;

a first idle roller provided at one end of the hinge member to be engaged with the first paper transfer roller as the hinge member is pivoted to a first position; and a second idle roller provided at the other end of the hinge member to be engaged with the second paper transfer roller as the hinge member is pivoted to a second position.

9. An image forming apparatus as claimed in claim 8, wherein the hinge member comprises a pivot axis interposed between the first and second idle rollers.

10. A paper reverse-feeding apparatus as claimed in claim 8, wherein the hinge member is pivoted between the first and second positions by a solenoid.

11. A method for printing both sides of a printing paper in an image forming apparatus, comprising:

printing a first side of the paper;

feeding the printing paper to a double-side-printing paper transfer path for reversing the printing paper;

rotating a first paper transfer roller in a first direction which is the same as the transfer direction of a single-side-printed paper and engaging a switching unit with the first transfer roller to feed the printed paper to said paper transfer path;

selectively engaging a second paper transfer roller with the switching unit and the paper and disengaging the first paper transfer roller from the paper and the switching unit; and rotating the second paper transfer roller located adjacent to the first paper transfer roller in a second direction opposite to the rotation direction of the first paper transfer roller to direct the paper in a second direction and reversing the direction of the printing paper.

12. The method as claimed in claim 11, wherein the steps of selectively engaging a second paper transfer roller and rotating the second paper transfer roller comprises:

pivoting a hinge member; and contacting a second idle roller on the hinge member to the second paper transfer roller to reverse the printing paper while simultaneously separating a first idle roller on the hinge member from the first paper transfer roller.

13. The method as claimed in claim 12, wherein the step of pivoting comprises:

pivoting the hinge member by a solenoid.

14. The method of claim 11, wherein said apparatus further comprises:

a first idle roller for selectively engaging the first paper transfer roller, and a second idle roller for selectively engaging the second paper transfer roller;

and wherein the method further comprises selectively engaging the first idle roller with the first paper transfer roller and conveying the paper in the first direction; and selectively engaging the second idle roller with the second paper transfer roller and conveying the paper in the second direction.

15. The paper reverse-feeding apparatus of claim 2, wherein the switching unit comprises a movable support having a first idle roller and a second idle roller, the movable support being movable between a first position where the first idle roller engages the first transfer roller to convey the paper in a first direction, and a second position where the second idle roller engages the second transfer roller to convey the paper in a second direction.

16. The paper reverse-feeding apparatus of claim 15, wherein said movable support is pivotal between said first position and said second position.

* * * * *